US007466938B2

(12) United States Patent
Tokuzaki

(10) Patent No.: US 7,466,938 B2
(45) Date of Patent: Dec. 16, 2008

(54) LASER BEAM PRINTER APPARATUS INCLUDING MOTOR COVER

(75) Inventor: Masaaki Tokuzaki, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 209 days.

(21) Appl. No.: 11/344,991

(22) Filed: Feb. 1, 2006

(65) Prior Publication Data

US 2006/0197827 A1 Sep. 7, 2006

(30) Foreign Application Priority Data

Mar. 4, 2005 (JP) ..... 2005-061163

(51) Int. Cl.
*G03G 15/00* (2006.01)

(52) U.S. Cl. ..... 399/107

(58) Field of Classification Search ..... 347/263; 399/107–126

See application file for complete search history.

(56) References Cited

FOREIGN PATENT DOCUMENTS

| | | | |
|---|---|---|---|
| JP | 02287377 A | * | 11/1990 |
| JP | 2001-194612 | | 7/2001 |
| JP | 2001-224145 | | 8/2001 |

OTHER PUBLICATIONS

Patent Abstracts of Japan, Application No. 2001-224145, dated Aug. 17, 2001 (2 pages).
Patent Abstracts of Japan, Application No. 2001-194612, dated Jul. 19, 2001 (2 pages).

* cited by examiner

*Primary Examiner*—Ryan Gleitz
(74) *Attorney, Agent, or Firm*—Osha • Liang LLP

(57) ABSTRACT

A laser beam printer apparatus includes a frame body including side plates formed to support a toner cartridge from a lateral direction and a horizontal plate, a motor secured on the inside of the side plate and having at least a portion arranged above the horizontal plate, and a motor cover arranged below the motor. The horizontal plate has an opening under the motor. The motor cover has locking nails formed to be locked to an edge of the opening.

3 Claims, 10 Drawing Sheets

LASER BEAM PRINTER APPARATUS INCLUDING MOTOR COVER

BACKGROUND OF THE INVENTION

1. Field of the Invention

The present invention relates to a laser beam printer apparatus. More specifically, the present invention relates to a laser beam printer apparatus including a motor cover.

2. Description of the Background Art

A laser beam printer apparatus includes a plurality of rollers each of which is driven by a motor.

FIG. 11 exemplarily shows a schematic cross-sectional view of a laser beam printer apparatus. A front side of the laser beam printer apparatus is shown on a right side in FIG. 11. This laser printer is formed to eject a sheet for printing such as paper toward the front side.

Each part of the laser beam printer apparatus is arranged inside an exterior cover 45. A paper tray 31 housing paper or the like for printing is arranged in a lower portion of exterior cover 45. A pickup roller 32 for removing the paper or the like from paper tray 31 is arranged on a rear end portion of paper tray 31. The paper or the like is conveyed along a conveying path 75 in a direction indicated with an arrow 70. The paper or the like is ejected to an ejected paper tray 3.

A conveying roller 33 for conveying the paper or the like is arranged around conveying path 75. A photoconductive drum 35 and a transfer roller 34 for arranging toner in a desired shape on a surface of the paper or the like are also arranged around conveying path 75. In addition, a fixing roller 36 for fixing toner arranged on the surface to the paper or the like is arranged around conveying path 75.

A toner cartridge 30 filled with toner is arranged on a substantial center portion of exterior cover 45. Toner cartridge 30 is formed in a replaceable form and, when toner is insufficient, can be replaced with another toner cartridge 30 filled with toner. Toner cartridge 30 can be removed from the front side of the laser beam printer apparatus.

An agitation plate 39 for agitating filling toner is formed inside-toner cartridge 30. Agitation plate 39 is formed in a flat shape and one end portion thereof is supported with a support shaft 40. Agitation plate 39 is formed to rock around support shaft 40 to agitate internal toner.

A developer roll 38 for arranging toner on photoconductive drum 35 is formed in a portion inside toner cartridge 30 adjacent to photoconductive drum 35. Developer roll 38 is formed in a columnar shape having a length in a width direction corresponding to a length of photoconductive drum 35. Developer roll 38 is arranged to attain line contact with photoconductive drum 35.

A blade 37 is formed on a side surface of developer roll 38 with one end portion thereof extending toward the surface of developer roll 38. Blade 37 can remove excessive toner arranged on the surface of developer roll 38.

As described above, a plurality of rollers are arranged in the laser beam printer apparatus to perform conveying of a sheet for printing, transfer of toner and the like. These rollers are driven by a motor. The laser beam printer apparatus includes a frame body arranged inside exterior cover 45. Various rollers, the motor and the like are secured to the frame body. A horizontal plate 28 of the frame body formed to extend in a horizontal direction is shown in FIG. 11.

FIG. 12 is an enlarged perspective view of a portion of the frame body on which a motor is arranged. A frame body 29 arranged inside the exterior cover includes a side plate 26 formed to extend in a vertical direction and horizontal plate 28 formed to extend in the horizontal direction.

Each of side plate 26 and horizontal plate 28 is formed with a resin. A cartridge frame body 14 is formed on the inside of side plate 26. Cartridge frame body 14 includes a cartridge insertion groove 52. The toner cartridge is inserted into cartridge insertion groove 52.

A motor 11 is secured to side plate 26 via a motor base 12. Motor 11 is secured to motor base 12. Motor base 12 is secured to side plate 26 with four screws 13.

In consideration of rotation directions of the plurality of rollers, motor 11 is secured to have a rotation shaft parallel to the horizontal direction. A recess portion 50 is formed in horizontal plate 28 to avoid interference with motor 11. Recess portion 50 is a concave portion extending downward. A portion of motor 11 is arranged in recess portion 50.

Japanese Patent Laying-Open No. 2001-224145 discloses a securing structure of a motor in a portable printer. This publication discloses that a protrusion of a motor cover is inserted into a screw hole for attaching a motor to fit a pair of snap plates arranged on a tip of the motor cover to a pair of groove plates of a motor housing portion to secure the motor to a reclosable cover.

A laser beam printer apparatus has been made smaller in recent years, and a motor, a plurality of rollers and the like are arranged in positions adjacent to each other.

Referring to FIG. 12, recess portion 50 is formed in horizontal plate 28 to ensure an arrangement region of the motor and avoid interference between horizontal plate 28 and motor 11. Screws 13 securing motor base 12 to side plate 26 are arranged on four corners of motor base 12.

During manufacturing of the laser beam printer apparatus, screw 13 arranged on an upper side can be readily fastened with a tool. Screw 13 arranged on a lower side, however, is difficult to fasten because the screw is arranged in recess portion 50, and therefore workability is decreased.

During maintenance such as inspection or repair, screw 13 arranged on the lower side is difficult to remove because the screw is hidden in recess portion 50. When a failure of motor 11 occurs and motor 11 is to be replaced, for example, motor 11 must be removed by using a special tool or after separating side plate 26 from horizontal plate 28.

SUMMARY OF THE NVENTION

An object of the present invention is to provide a laser beam printer apparatus having increased productivity and increased workability of maintenance.

A laser beam printer apparatus in one aspect of the present invention includes an exterior cover, a frame body made of a metal arranged inside the exterior cover and including a side plate and a horizontal plate having an opening, a motor arranged above the opening and secured on the inside of the side plate with a screw, and a cartridge frame body secured to the side plate for supporting a toner cartridge. The laser beam printer apparatus also includes a motor cover arranged in the opening and locked to the horizontal plate, two torsion springs arranged on a bottom surface of the motor cover and having elasticity to press the inserted toner cartridge from an upper side to a lower side, a lead connected to the torsion springs, and a detector for receiving a signal of the lead to detect insertion of the toner cartridge into the cartridge frame body. The motor cover includes a first locking nail formed in an end portion on one side thereof in a front-and-rear direction and a second locking nail formed in an end portion on the other side thereof in the front-and-rear direction, and each of the first locking nail and the second locking nail is formed to catch an edge of the opening. Each of the torsion springs is arranged to contact an identification electrode formed on the toner cartridge. The torsion springs press the toner cartridge downward when the toner cartridge is inserted into the cartridge frame body and, furthermore, contact between the torsion spring and the identification electrode is achieved to allow detection of insertion of the toner cartridge into the cartridge frame body. The first locking nail and the second locking nail are formed to allow the motor cover to be removed from the opening. The motor cover can be removed by removing the exterior cover. The screw securing the motor to the side plate can be removed by removing the motor cover. With adopting this construction, the laser beam printer apparatus having increased productivity and increased workability of maintenance can be provided.

A laser beam printer apparatus in another aspect of the present invention includes a frame body including side plates formed to support a toner cartridge from a lateral direction and a horizontal plate for securing the side plates to each other, a motor secured on the inside of the side plate and having at least a portion arranged above the horizontal plate, and a motor cover arranged below the motor. The frame body is formed with a metal, the horizontal plate has an opening under the motor, and the motor cover has a locking portion formed to be locked to an edge of the opening. With adopting this construction, the laser beam printer apparatus having increased productivity and increased workability of maintenance can be provided.

The above-described invention preferably includes a torsion spring arranged on the outside of the motor cover and having elasticity, a lead connected to the torsion spring, and a detector for receiving a signal of the lead to detect insertion of the toner cartridge into the frame body. The torsion spring is arranged to press the toner cartridge downward when the toner cartridge is inserted into the frame body, and the torsion spring is arranged to contact an identification electrode formed on the toner cartridge when the toner cartridge is inserted into the frame body. With adopting this construction, a force of the torsion spring for pressing the toner cartridge from an upper side can be adjusted. In addition, the torsion spring can include a function for detecting insertion of the toner cartridge into the frame body.

In the above-described invention, the torsion spring preferably includes a coil portion having a coiled form, a contact portion formed with one extending end portion of the coil portion bent to have a convex shape when seen from a lateral direction, and an abutting portion formed with the other extending end portion of the coil portion having a linear shape. The contact portion is arranged to contact the identification electrode when the toner cartridge is inserted into the frame body, and the abutting portion is arranged to abut on the motor cover. The motor cover has a support portion having a rod-like shape and arranged inside the coil portion for supporting the coil portion, a spring restraining portion for restraining a position of a tip of the abutting portion, and a spring boss portion formed on a tip of the support portion for restraining a movement of the coil portion in an extending direction of the support portion. With adopting this construction, the torsion spring can be formed in a simple construction.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

A laser beam printer apparatus in an embodiment according to the present invention will now be described referring to FIGS. 1-11.

Figure 1:
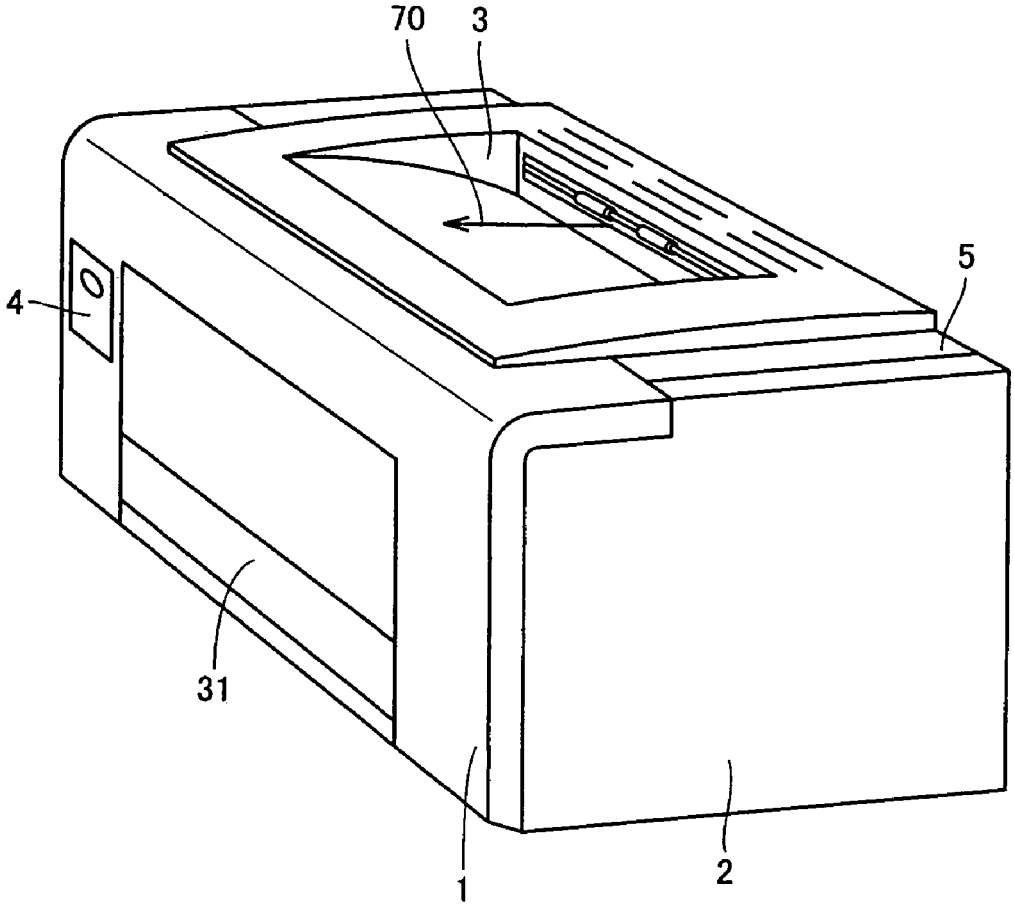
FIG. 1 is a schematic perspective view of a laser beam printer apparatus in an embodiment.

FIG. 1 is a schematic perspective view of the laser beam printer apparatus in this embodiment. In the laser beam printer apparatus in this embodiment, toner is arranged on a photoconductive drum and the toner transferred to the photoconductive drum is transferred to a sheet for printing.

Figure 11:
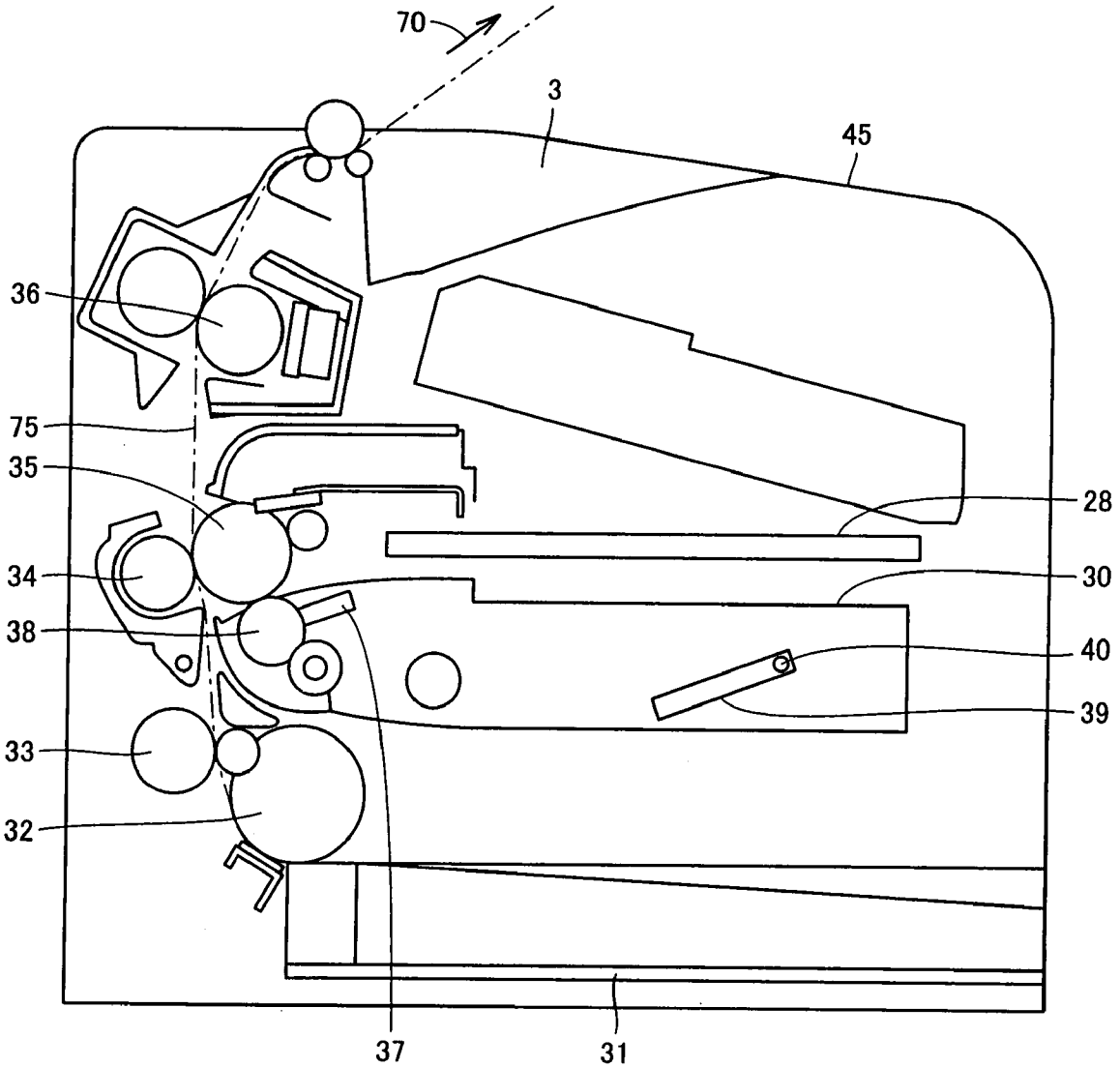
FIG.11 PRIOR ART
FIG. 11 is a schematic cross-sectional view of a laser beam printer apparatus.
Figure 12:
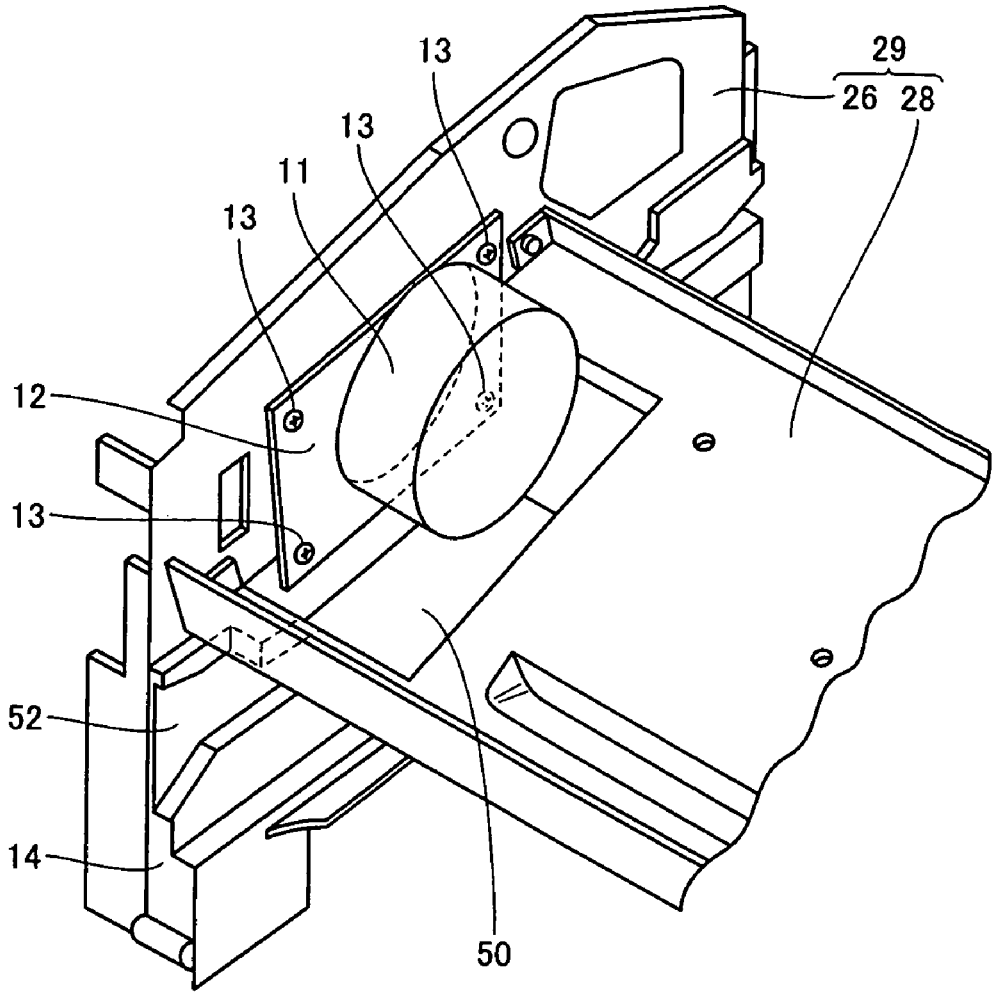
FIG.12 PRIOR ART
FIG. 12 is an enlarged perspective view of a portion of a frame body with a motor based on a conventional technique.

Referring to FIGS. 1 and 11, the laser beam printer apparatus in this embodiment includes an exterior cover 45. Exterior cover 45 includes a front surface cover 1 arranged on a front side, a side surface cover 2 arranged on a side surface, and a top surface cover 5 arranged on a top surface.

A paper tray 31 is arranged in a lower portion of front surface cover 1. Paper tray 31 can be removed from the front side of the laser beam printer apparatus. An ejected paper tray 3 is formed on top surface cover 5 of the laser beam printer apparatus. A manipulation portion 4 is arranged on a front surface of the laser beam printer apparatus. The laser beam printer apparatus is formed such that setting of printing or the like can be made by manipulating manipulation portion 4.

Referring to FIG. 1, when printing is performed, a sheet for printing such as paper arranged in paper tray 31 is fed to an internal portion of the laser beam printer apparatus. Printing on the sheet for printing is performed inside the laser beam printer apparatus, and the sheet for printing is ejected to ejected paper tray 3 as indicated with an arrow 70.

Figure 2:
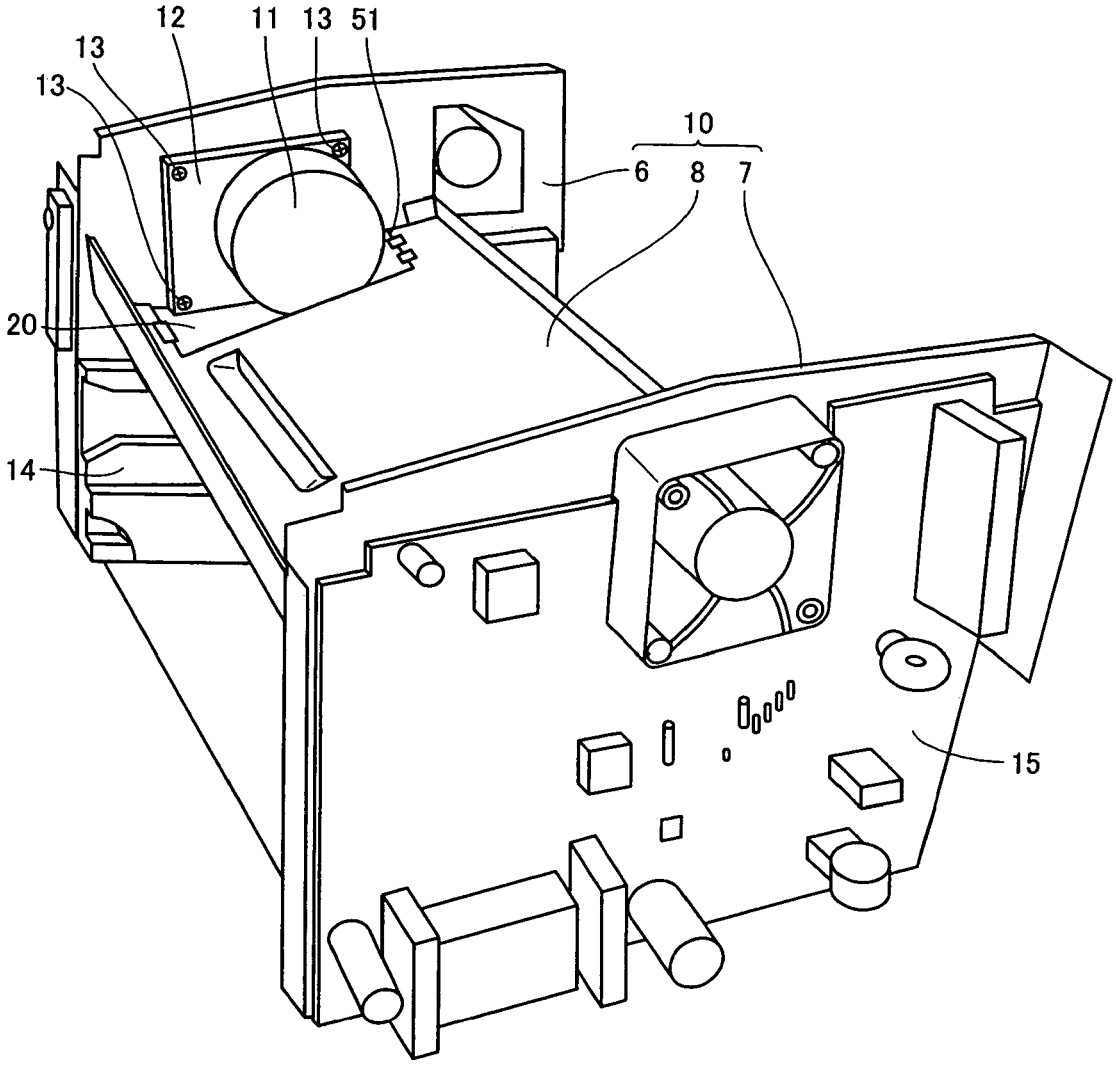
FIG. 2 is a schematic perspective view of a frame body in the embodiment.

FIG. 2 is a schematic perspective view of a frame body of the laser beam printer apparatus in this embodiment. FIG. 2 is a schematic perspective view in which the exterior cover of the laser beam printer apparatus is removed and rollers and the like are further removed. A left side of FIG. 2 corresponds to the front side of the laser beam printer apparatus, and a right side corresponds to a rear side of the laser beam printer apparatus.

A frame body 10 includes a horizontal plate 8 formed to have a main surface extending in a horizontal direction and side plates 6 and 7 each formed to have a main surface extending in a vertical direction. Side plates 6 and 7 are arranged to have respective main surfaces opposite to each other. Horizontal plate 8 is formed to secure side plates 6 and 7.

In this embodiment, each of horizontal plate 8 and side plates 6, 7 is made of a metal. With adopting this construction, strength of the frame body can be increased and stable printing is enabled. In addition, the horizontal plate can be formed easier than a horizontal plate formed with a resin so as to have a recess portion. Furthermore, accuracy of fabrication is increased by forming the frame body with a metal.

A circuit substrate 15 having a cooling fan, an electric circuit and the like formed thereon is arranged on the outside of side plate 7. A motor 11 is secured to side plate 6 via a motor base 12. Motor 11 is secured to motor base 12, and motor base 12 is secured to side plate 6 with screws 13. Screws 13 are respectively arranged on four corners of a rectangle of a plane shape of motor base 12.

A cartridge frame body 14 for supporting a toner cartridge is secured to the inside of each of side plates 6, 7. Cartridge frame body 14 is arranged below horizontal plate 8. In this embodiment, cartridge frame body 14 is formed with a resin.

Figure 3:
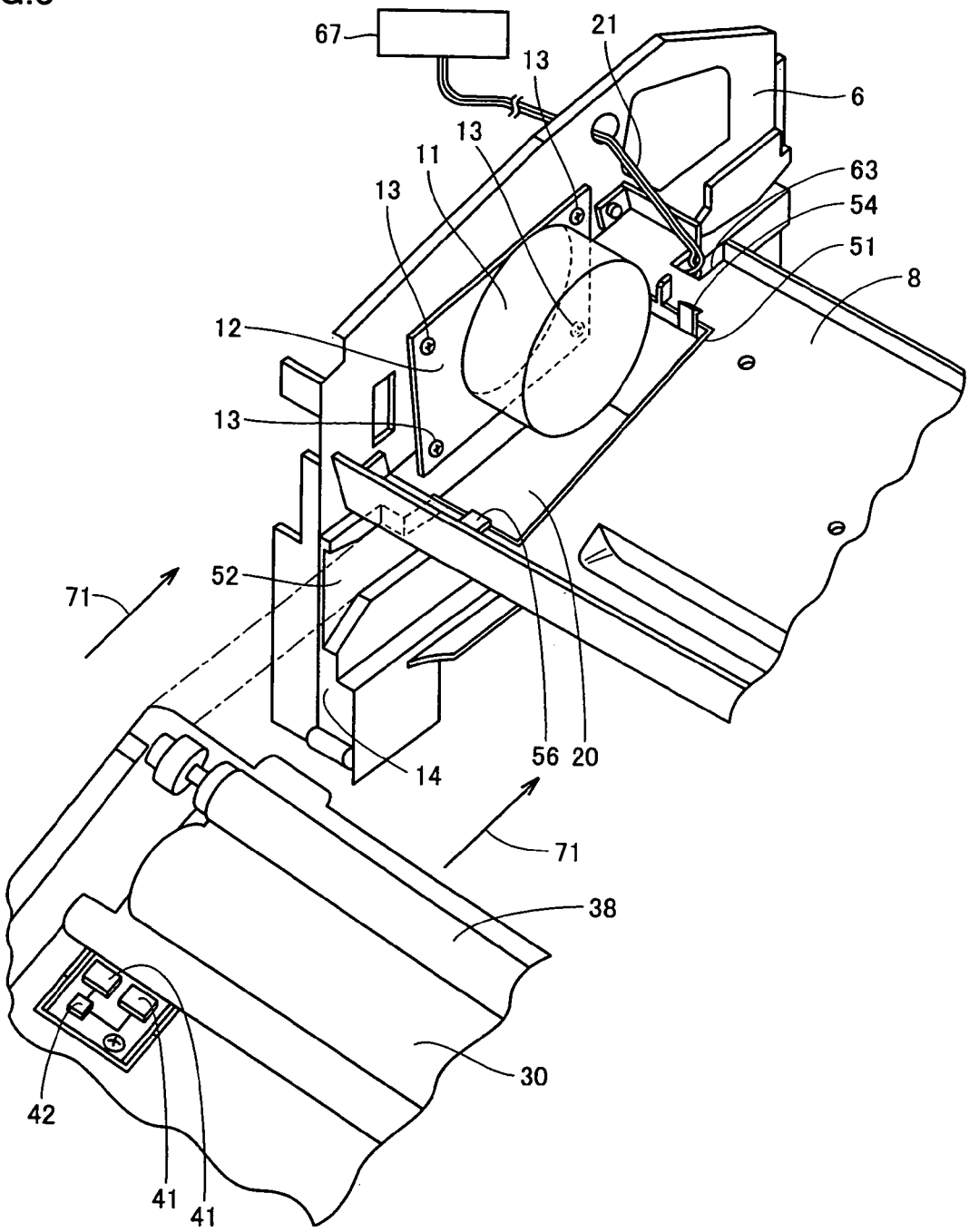
FIG. 3 is an enlarged schematic perspective view of a portion of the frame body in the embodiment, on which a motor is secured.

FIG. 3 is an enlarged perspective view of a portion of the frame body on which the motor is arranged. Cartridge frame body 14 has a cartridge insertion groove 52 for inserting the cartridge therein. Cartridge insertion groove 52 is formed along a front-and-rear direction of the laser beam printer apparatus. Cartridge insertion groove 52 is formed such that a toner cartridge 30 can be inserted in a direction indicated with an arrow 71.

In this embodiment, horizontal plate 8 has an opening 51 in a region directly below motor 11. Opening 51 is formed to have a rectangular plane shape. A motor cover 20 is arranged in opening 51. Motor cover 20 is formed with a resin. Motor cover 20 is formed corresponding to an exterior of motor 11 so as not to interfere with motor 11. Motor cover 20 is secured to horizontal plate 8 with locking nails 54, 56 locked to an edge of opening 51 of horizontal plate 8.

A detector 67 for receiving a signal of a lead 21 connected to a torsion spring described below to detect insertion of the toner cartridge into cartridge frame body 14 is formed on an outer surface of side plate 6.

Figure 4:
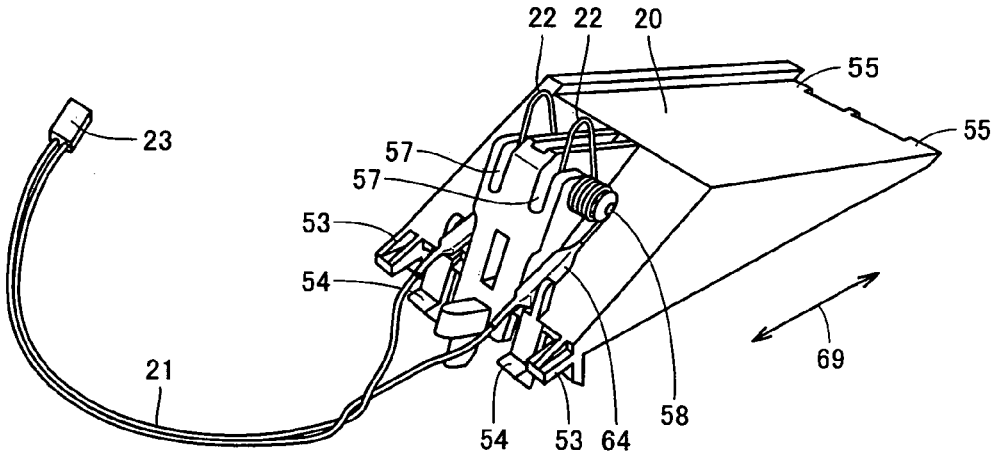
FIG. 4 is a schematic perspective view of a motor cover in the embodiment.

FIG. 4 is a schematic perspective view of the motor cover. The front-and-rear direction of the laser beam printer apparatus is indicated with an arrow 69. Motor cover 20 is formed to have a triangular shape when seen from a side surface thereof. Motor cover 20 is formed to have a convex shape extending downward when attached to the horizontal plate. Two torsion springs 22 having elasticity are arranged on a bottom surface of the motor cover.

Respective one end portions of torsion springs 22 are connected to two leads 21. Respective leads 21 are connected to respective torsion springs 22. A connector 23 is arranged on tips of leads 21. Connector 23 is formed to allow connection with detector 67 arranged on the outside of the side plate of the frame body.

Figure 5:
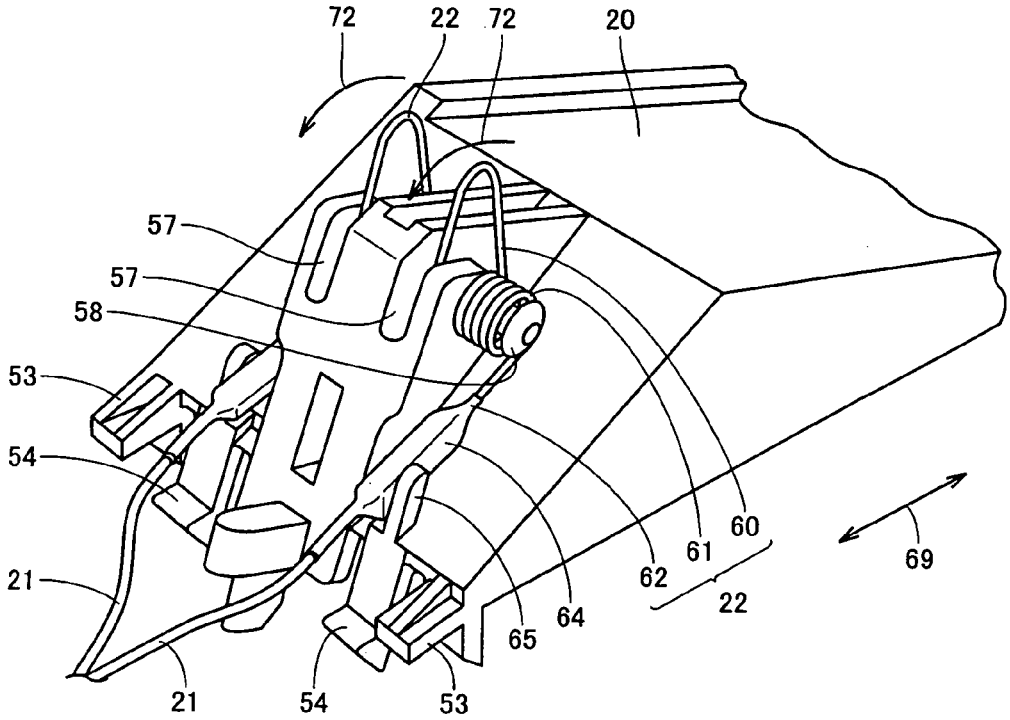
FIG. 5 is an enlarged perspective view of a portion of the motor cover in the embodiment, on which torsion springs are arranged.

FIG. 5 is an enlarged perspective view of a portion of the motor cover on which the torsion springs are arranged. The front-and-rear direction of the laser beam printer apparatus is indicated with arrow 69.

Motor cover 20 includes locking nail 54 as a first locking nail which is formed on an end portion of one side in the front-and-rear direction. Locking nail 54 is formed to extend upward and has a protrusion on a tip thereof. Two locking nails 54 are formed in a width direction of motor cover 20.

Motor cover 20 includes locking nails 53 formed on the end portion of one side in the front-and-rear direction in either end portion in the width direction. Two locking nails 53 are formed to project to the front side. Motor cover 20 is formed such that locking nail 53 and locking nail 54 can sandwich therebetween the edge of the opening of the horizontal plate.

Torsion spring 22 includes a contact portion 60, a coil portion 61 and an abutting portion 62. In this embodiment, torsion spring 22 is formed with one metal wire. Torsion spring 22 is arranged on the bottom surface of motor cover 20 corresponding to the rear side of the laser beam printer apparatus.

Coil portion 61 is formed with a coiled metal wire. A support portion 58 is inserted into coil portion 61. Contact portion 60 is formed with one extending end portion of coil portion 61 bent to have a convex shape when seen from a lateral direction. Contact portion 60 is formed to extend downward when motor cover 20 is attached to the horizontal plate. Contact portion 60 is formed to have elasticity and tilt in a direction indicated with an arrow 72.

Abutting portion 62 is electrically connected to lead 21 via a connection portion 64. Abutting portion 62 having a linear shape is formed with the other extending end portion of coil portion 61. Abutting portion 62 is formed to contact the bottom surface of the motor cover.

Motor cover 20 includes a spring restraining portion 65 for restraining a movement of abutting portion 62 in the width direction of motor cover 20. In this embodiment, spring restraining portion 65 is formed to restrain a movement of connection portion 64 in the width direction. Spring restraining portion 65 is formed to project downward from the bottom surface of motor cover 20.

A groove portion 57 is formed in motor cover 20 to allow contact portion 60 to move in the direction indicated with arrow 72. Groove portion 57 is formed along a direction of movement of contact portion 60 so as not to inhibit the movement of contact portion 60.

Torsion spring 22 is formed such that, when contact portion 60 moves in the direction indicated with arrow 72, abutting portion 62 abuts on motor cover 20 and then contact portion 60 is powered to return to an original position by action of coil portion 61.

Figure 6:
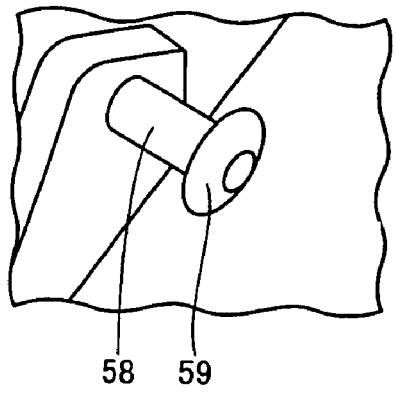
FIG. 6 is an enlarged perspective view of a support portion of the motor cover in the embodiment.

Motor cover 20 has support portion 58 having a rod-like shape and arranged inside coil portion 61 for supporting torsion spring 22. FIG. 6 is an enlarged perspective view of the support portion. A spring boss portion 59 is formed on a tip of support portion 58 for restraining a movement of the coil portion in an extending direction of support portion 58. Spring boss portion 59 is formed to have a diameter larger than that of a rod-like portion of support portion 58. Spring boss portion 59 is formed to prevent the coil portion from being detached from support portion 58.

Figure 7:
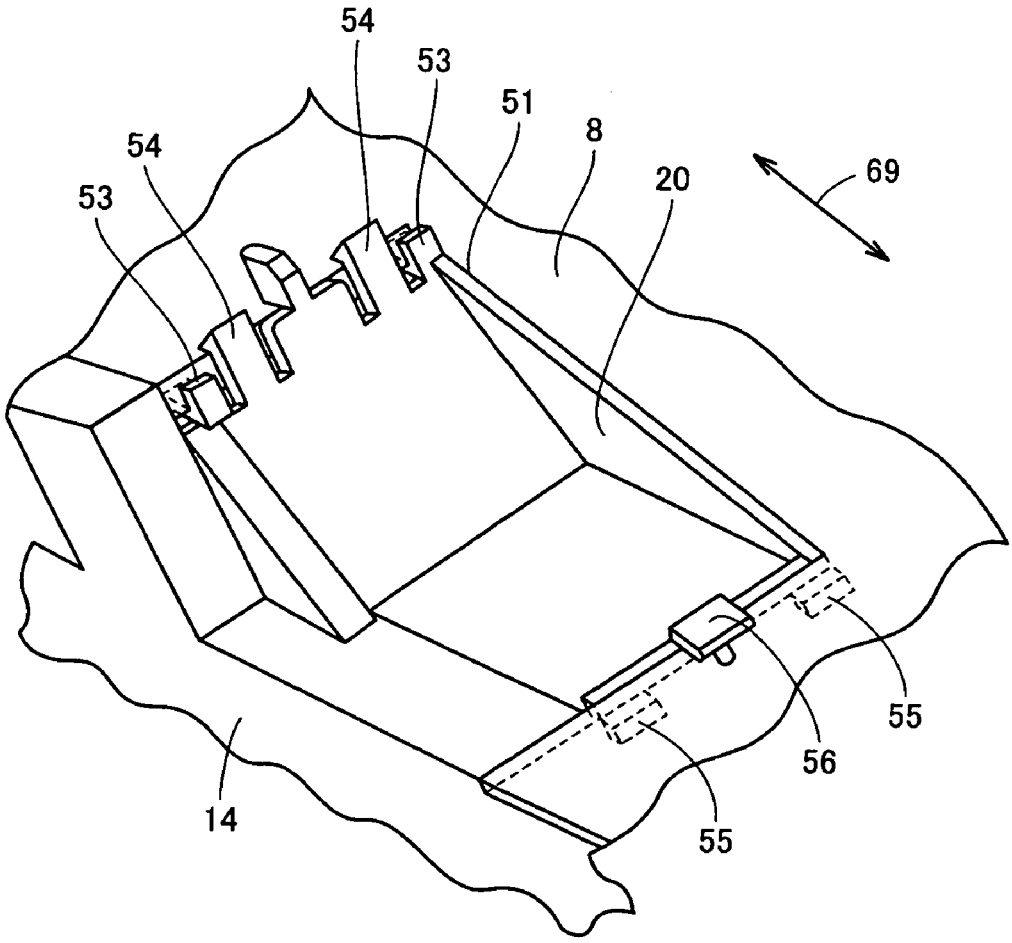
FIG. 7 is a schematic perspective view describing engagement of a horizontal plate and the motor cover in the embodiment.

FIG. 7 is a schematic perspective view describing a state in which the motor cover is secured to the horizontal plate. FIG. 7 is the schematic perspective view seen from an upper side. The front-and-rear direction of the laser beam printer apparatus is indicated with arrow 69.

Motor cover 20 is attached to horizontal plate 8 so as to have a concave shape extending downward. Referring to FIGS. 5 and 7, one end portion of motor cover 20 is supported with locking nail 53 and locking nail 54 sandwiching the edge of opening 51 of horizontal plate 8.

Motor cover 20 includes locking nail 56 as a second locking nail which is formed on the other end portion. Motor cover 20 further includes a locking nail 55 formed on the other end portion. Locking nail 56 is formed to extend upward and has a protrusion on a tip thereof. Locking nail 55 is formed to project to the outside.

Locking nail 56 is formed in a substantial center portion in the width direction of motor cover 20, and locking nails 55 are arranged in either end portion in the width direction. Locking nail 56 and locking nail 55 are formed such that the edge of opening 51 can be sandwiched therebetween.

As described above, the first and second locking nails are formed on both end portions in the front-and-rear direction, and each of the locking nails is formed to catch the edge of the opening of the horizontal plate. With adopting this construction, the motor cover can be readily mounted and removed. Referring to FIG. 7, when motor cover 20 is pressed in a forward direction, for example, motor cover 20 slightly bends to disengage locking nails 55, 56 on the rear side, and thereby motor cover 20 can be readily removed downward.

Figure 8:
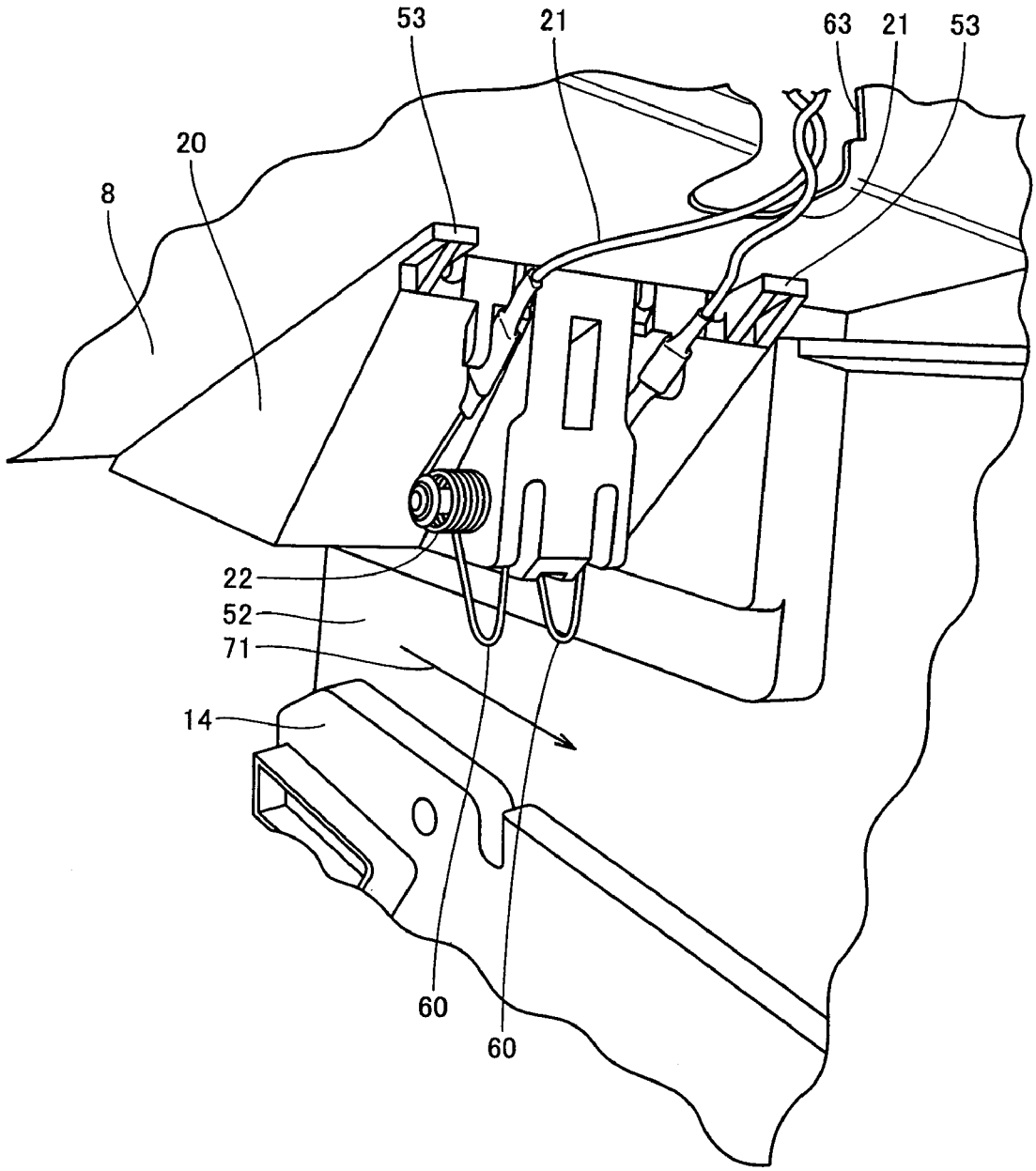
FIG. 8 is a schematic perspective view of the motor cover attached to the horizontal plate in the embodiment.

FIG. 8 is a schematic perspective view of motor cover 20 attached to horizontal plate 8. Motor cover 20 is attached to horizontal plate 8 with torsion spring 22 arranged on the rear side. In addition, motor cover 20 is attached with contact portion 60 of torsion spring 22 extending downward. Lead 21 is guided to an upper side of horizontal plate 8 through a notch portion 63 formed in horizontal plate 8.

Referring to FIG. 3, lead 21 is guided to the outside of side plate 6 through a hole formed in a portion of side plate 6 above horizontal plate 8. The connector attached to the tip of lead 21 is connected to detector 67 arranged on the outside of side plate 6.

Referring to FIG. 8, cartridge insertion groove 52 of cartridge frame body 14 is formed below motor cover 20. The toner cartridge is inserted in the direction indicated with arrow 71.

Figure 9:
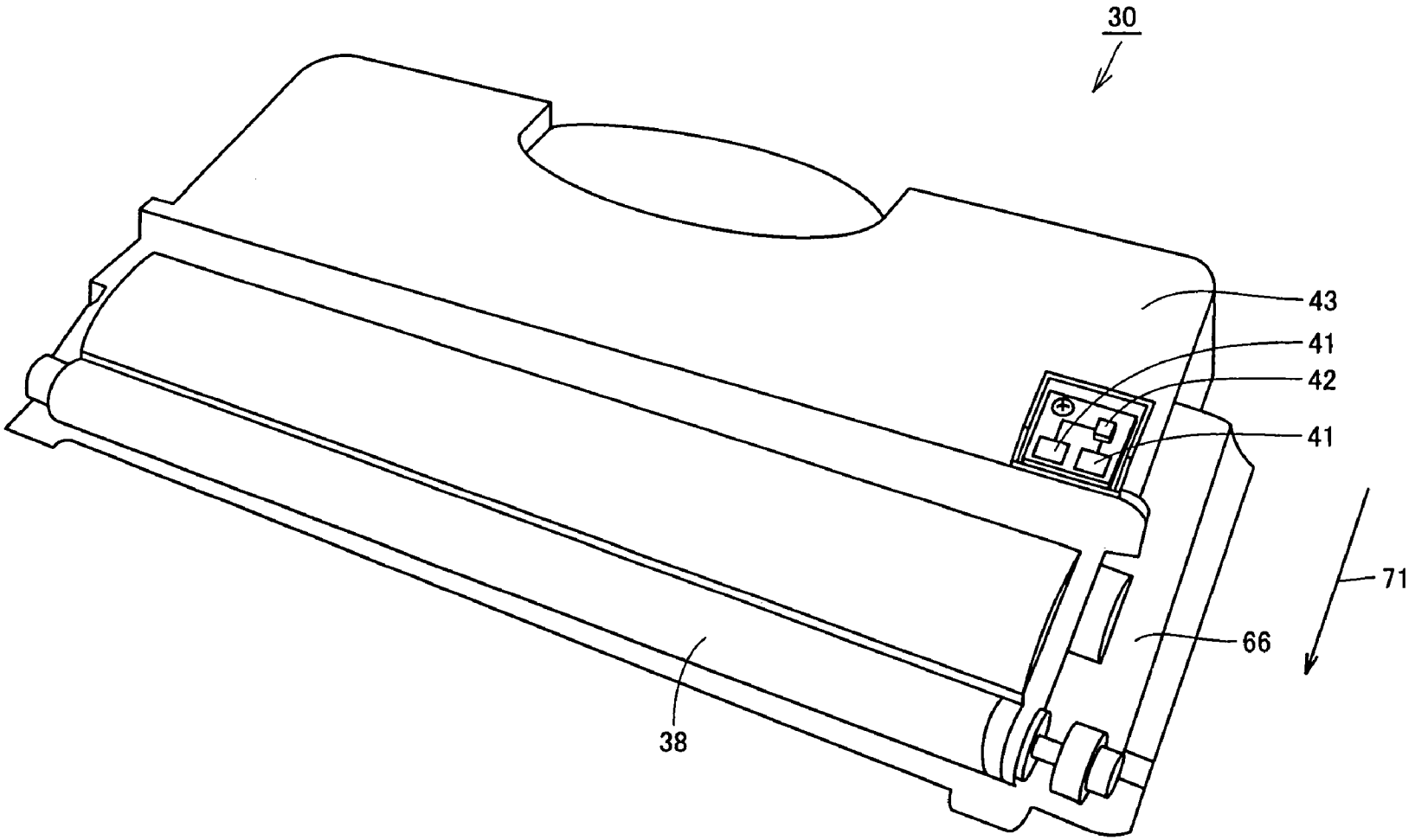
FIG. 9 is a schematic perspective view of a toner cartridge.

FIG. 9 is a schematic perspective view of the toner cartridge of the laser beam printer apparatus in this embodiment. Toner cartridge 30 is formed in a substantial rectangular parallelepiped shape. Toner cartridge 30 includes a cartridge exterior body 43 and a developer roll 38.

Developer roll 38 is formed to extend in a width direction of toner cartridge 30. Developer roll 38 is formed to expose an upper side thereof. Two detection electrodes 41 are formed on a top surface of cartridge exterior body 43. Detection electrodes 41 are connected to each other via a chip 42. Chip 42 is formed to be able to generate a prescribed signal when detection electrodes 41 are connected to each other.

Toner cartridge 30 is inserted into the cartridge frame body in the direction indicated with arrow 71. An overhanging portion 66 is inserted into the cartridge insertion groove formed in the cartridge frame body.

Figure 10:
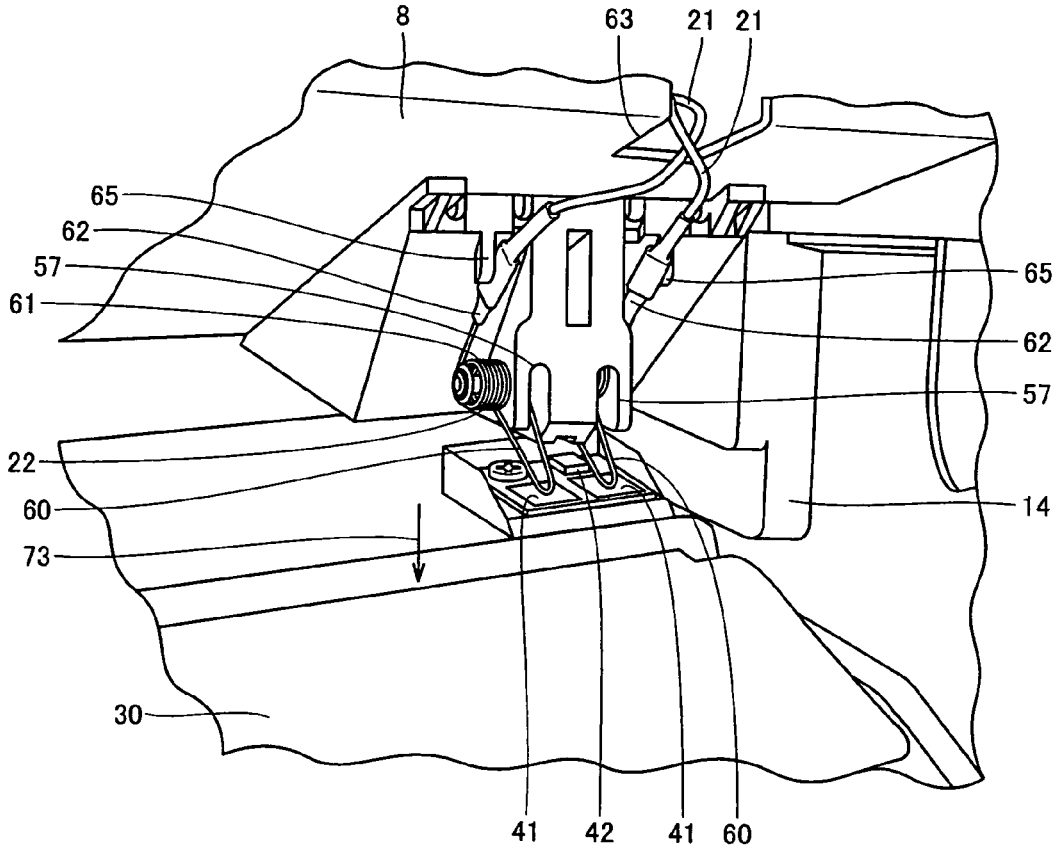
FIG. 10 is an enlarged schematic perspective view of a portion including the motor cover when the toner cartridge is inserted into the frame body in the embodiment.

FIG. 10 is an enlarged perspective view of a portion including the motor cover when the toner cartridge is inserted into the frame body. Respective torsion springs 22 are arranged to contact respective detection electrodes 41 when toner cartridge 30 is inserted. Contact portion 60 of one torsion spring 22 contacts one detection electrode 41 while contact portion 60 of the other torsion spring 22 contacts the other detection electrode 41.

Since torsion springs 22 have elasticity, respective contact portions 60 contact respective detection electrodes 41 while powered in a direction toward detection electrodes 41. Therefore, contact portion 60 and detection electrode 41 can be reliably brought into conduction. A signal from chip 42 is transmitted to detector 67 via two detection electrodes 41 and two contact portions 60. As a result, insertion of toner cartridge 30 into the frame body can be detected with detector 67.

Referring to FIG. 11, developer roll 38 arranged in toner cartridge 30 attains line contact with a photoconductive drum 35. A pressing force of developer roll 38 to photoconductive drum 35 must be strictly adjusted because developer roll 38 has a role to supply toner to photoconductive drum 35.

Referring to FIG. 10, since contact portion 60 of torsion spring 22 in this embodiment is powered in a direction indicated with an arrow 73, toner cartridge 30 can be pressed downward. Therefore, the pressing force of the developer roll to the photoconductive drum can be adjusted by adjusting elasticity of the torsion spring.

That is, when the elasticity of torsion spring 22 is increased, toner cartridge 30 can be strongly pressed downward and the pressing force of the developer roll to the photoconductive drum can be decreased. Alternatively, the pressing force of the developer roll to the photoconductive drum can be increased by decreasing the elasticity of torsion spring 22.

Referring to FIGS. 3 and 7, in the laser beam printer apparatus in this embodiment, motor cover 20 can be attached after motor base 12 with motor 11 secured thereto is attached to side plate 6. Therefore, screw 13 arranged on a lower side of motor base 12 can be readily fastened through opening 51 formed in horizontal plate 8. Thereafter, motor cover 20 can be readily attached.

In addition, during maintenance such as for replacement of motor 11, motor cover 20 can be readily removed by detaching lead 21 from detector 67 and then detaching locking nails 53, 54 or locking nails 55, 56 from opening 51 of horizontal plate 8. As a result, screw 13 arranged on the lower side of motor base 12 can be readily removed through opening 51. Separation of the motor, which needed disassembling of the frame body in a conventional technique, can be readily performed without disassembling the frame body.

As described above, in the present invention, productivity in manufacturing and workability of maintenance are increased. Furthermore, the motor cover can include a function for detecting insertion of the toner cartridge and a function for adjusting the pressing force of the developer roll by arranging the torsion springs on the motor cover.

Though the motor cover is formed with a resin in this embodiment, the motor cover is not limited to this form and an arbitrary material can be used. The motor cover is preferably formed with a material which can bend in a direction of formation of a locking portion. With adopting this construction, the motor cover can be readily removed from the horizontal plate. In addition, the motor cover is preferably formed with a material having an insulating property when the torsion spring includes the function for detecting insertion of the toner cartridge into the frame body.

In addition, though the locking portion is formed to sandwich the horizontal plate in the front-and-rear direction in this embodiment, the locking portion is not limited to this and can take any form as long as mounting and removal are enabled.

Furthermore, though the torsion spring is arranged on the bottom surface of the motor cover in this embodiment, the torsion spring is not limited to this form and can be arranged on, for example, another member formed on a lower side of the horizontal plate.

According to the present invention, a laser beam printer apparatus having increased productivity and increased workability of maintenance can be provided.

In the drawings, the same or corresponding portions are indicated with the same characters.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A laser beam printer apparatus, comprising:

an exterior cover;

a frame body made of a metal arranged inside said exterior cover and including a side plate and a horizontal plate having an opening;

a motor arranged above said opening and secured on the inside of said side plate with a screw;

a cartridge frame body secured to said side plate for supporting a toner cartridge;

a motor cover arranged in said opening and locked to said horizontal plate;

two torsion springs arranged on a bottom surface of said motor cover and having elasticity to press inserted said toner cartridge from an upper side to a lower side;

a lead connected to said torsion springs; and detection means for receiving a signal of said lead to detect insertion of said toner cartridge into said cartridge frame body; wherein said motor cover includes a first locking nail formed in an end portion on one side thereof in a front-and-rear direction and a second locking nail formed in an end portion on the other side thereof in said front-and-rear direction, each of said first locking nail and said second locking nail is formed to catch an edge of said opening, each of said torsion springs is arranged to contact an identification electrode formed on said toner cartridge, said torsion springs press said toner cartridge downward when said toner cartridge is inserted into said cartridge frame body, said toner cartridge is inserted into said cartridge frame body to achieve contact between said torsion spring and said identification electrode to allow detection of insertion of said toner cartridge into said cartridge frame body, said first locking nail and said second locking nail are formed to allow said motor cover to be removed from said opening, said motor cover can be removed by removing said exterior cover, and said screw securing said motor to said side plate can be removed by removing said motor cover.

2. A laser beam printer apparatus, comprising:

a frame body including side plates formed to support a toner cartridge from a lateral direction and a horizontal plate for securing the side plates to each other;

a motor secured on the inside of said side plate and having at least a portion arranged above said horizontal plate;

a motor cover arranged below said motor;

a torsion spring arranged on the outside of said motor cover and having elasticity;

a lead connected to said torsion spring; and detection means for receiving a signal of said lead to detect insertion of said toner cartridge into said frame body; wherein said frame body is formed with a metal, said horizontal plate has an opening under said motor, said motor cover has a locking portion formed to be locked to an edge of said opening, said torsion spring is arranged to press said toner cartridge downward when said toner cartridge is inserted into said frame body, and said torsion spring is arranged to contact an identification electrode formed on said toner cartridge when said toner cartridge is inserted into said frame body.

3. The laser beam printer apparatus according to claim 2, wherein said torsion spring includes a coil portion having a coiled form, a contact portion formed with one extending end portion of said coil portion bent to have a convex shape when seen from a lateral direction, and an abutting portion formed with the other extending end portion of said coil portion having a linear shape;

said contact portion is arranged to contact said identification electrode when said toner cartridge is inserted into said frame body;

said abutting portion is arranged to abut on said motor cover; and said motor cover has a support portion having a rod-like shape and arranged inside said coil portion for supporting said coil portion, a spring restraining portion for restraining a position of a tip of said abutting portion, and a spring boss portion formed on a tip of said support portion for restraining a movement of said coil portion in an extending direction of said support portion.

* * * * *